US005314774A

United States Patent [19]

Camis

[11] Patent Number: 5,314,774

[45] Date of Patent: May 24, 1994

[54] METHOD AND APPARATUS FOR DEVELOPING COLOR IMAGES USING DRY TONERS AND AN INTERMEDIATE TRANSFER MEMBER

[75] Inventor: Thomas Camis, Boise, Id.

[73] Assignee: Hewlett-Packard Company, Palo Alto, Calif.

[21] Appl. No.: 888,566

[22] Filed: May 22, 1992

[51] Int. Cl.[5] ..... G03G 13/01

[52] U.S. Cl. ..... 430/47; 430/42; 430/48; 430/102; 430/126; 355/245; 355/259; 355/272; 355/274; 355/326 R; 355/327; 118/644; 118/645; 118/651; 118/653

[58] Field of Search ..... 430/42, 47, 48, 102, 430/126; 355/259, 272, 245, 274, 326, 327, 259; 118/645, 644, 653

[56] References Cited

U.S. PATENT DOCUMENTS

| | | | |
|---|---|---|---|
| 3,904,406 | 9/1975 | Takahashi | 96/1.4 |
| 4,961,094 | 10/1990 | Yamaoki et al. | 355/326 |
| 5,012,289 | 4/1991 | Aldrich et al. | 355/260 |
| 5,086,728 | 2/1992 | Kinoshita | 118/653 |
| 5,111,302 | 5/1992 | Chan et al. | 358/298 |

*Primary Examiner*—John Kight, III
*Assistant Examiner*—Duc Truong

[57] ABSTRACT

An electrophotographic method and apparatus for developing and printing color images by the electrostatic projection of dry powder color toners onto a photoconductive member. A plurality of color toner projection units are spaced from the photoconductive member and are AC and DC biased to sequentially project each of the cyan, yellow, magenta, and black color planes onto the photoconductive member. The photoconductive member is directly driven against an intermediate transfer member which sequentially receives and stores each of the color planes to thereby form a composite color image, and each color plane is transferred from the photoconductive member before the next color plane is received thereon. The composite color image is then directly transferred to the print medium, whereby the use of the intermediate transfer member eliminates the problems of counter potentials at the surface of the photoconductive member and enables dot-on-dot (DOD) formatting to be utilized for achieving the maximum resolution and print quality of the printed image.

6 Claims, 5 Drawing Sheets

DRY POWDER NON-MAGNETIC
TONER DEVELOPMENT DEVICE

TONER LAYER THICKNESS VERSUS TRIBO

METHOD AND APPARATUS FOR DEVELOPING COLOR IMAGES USING DRY TONERS AND AN INTERMEDIATE TRANSFER MEMBER

TECHNICAL FIELD

This invention relates generally to electrophotographic color printers using dry powder color toners and more particularly to such printers using an intermediate transfer belt located between a main photoconductor member and the print media.

BACKGROUND ART AND RELATED APPLICATIONS

In the field of electrophotographic color printing, liquid color toners have been frequently used to successively develop selected color images, such as images in cyan, yellow, magenta, and black color planes, on a photoconductive drum and superimposed thereon, one upon another. The composite color image is then transferred to the adjacent print media passing between the photoconductive drum and a transfer roller of known construction. Liquid color toners have certain advantages over dry color toners in electrophotographic color printers where the liquid color toners were transferred directly by physical contact between the photoconductive drum and the sources of liquid color toners. Image development systems of the above type which use liquid color toners are described, for example, in my copending application Ser. No. 07/701,926, entitled "Method And Apparatus For Preparing Liquid Toner To The Media During Electrostatic Printing" filed May 17, 1991, also in my copending application Ser. No. 07/704,572, entitled "Electrostatically Assisted Transfer Roller And Method For Directly Transferring Liquid Toner To A Print Medium" filed May 17, 1991, and also in my copending application Ser. No. 07/748,120 entitled "Improved Conditioning Roller and Method of Operation For Use With A Photoconductive Drum In An Electrophotographic Printer" filed Aug. 21, 1991, all assigned to the present assignee and incorporated herein by reference.

Certain of the above types of liquid toner color development systems are characterized by several distinct disadvantages, among which include many problems associated with managing the carrier fluid, e.g. an isopar, for the color toner particles. In addition, when dot-on-dot (DOD) formatting was chosen over dot-next-to-dot (DND) formatting to obtain the highest possible resolutions, complicated algorithms were required in order to compensate for the undesirable counter potentials which were developed when one liquid toner was developed directly upon previously developed different liquid toner on the surface of the photoconductive drum. This latter compensation had the effect of reducing the net charge on the toner, and the reduction of the net charge on the toner, in turn, had the resultant effect of degrading the image quality of the developed image, since the net charge on the toner would otherwise assist in holding the developed image in place.

In order to overcome the above problems associated with liquid color toner development systems, a new and improved dry color toner projection system was developed and is described and claimed in my copending application Ser. No. 07/847,445 entitled "Non-Magnetic Dry Toner Color Printer and Method of Operation", filed Mar. 6, 1992, assigned to the present assignee and incorporated herein by reference. This dry color toner projection system represents a significant advance in the field of electrophotographic color printing for reasons set forth in detail in this copending application. However, in order to avoid problems associated with the above counter potentials produced when dot-on-dot formatting is used, the color development system in my above identified copending application chose dot-next-to-dot formatting for its preferred embodiment in order to avoid the use of complex algorithms to compensate for the above counter potentials produced using DOD formatting. However, but for this latter consideration and the various problems associated with the DOD counter potentials, DOD formatting would have been preferred over DND formatting as a means for optimizing the resolution of the developed image.

SUMMARY OF INVENTION

The general purpose and principal object of the present invention is to provide still further new and useful improvements with respect to the invention described in my above identified copending application and improvements which enable the use of dot-on-dot formatting in a dry powder color toner image development system. Simultaneously, the present invention eliminates the above problems encountered with respect to counter potentials at the surface of the photoconductive member and thereby maintains a relatively high net charge on the toner to enhance print quality.

To accomplish this purpose and object, there has been discovered and developed a new and improved system and method for developing color images wherein an intermediate transfer member is positioned between a photoconductive member of the development system and the print medium. This intermediate transfer member is operated in such a manner that after each color plane is developed on the photoconductive member, it is transferred by direct physical contact and stored on the surface of the intermediate transfer member.

By this operation, when the next color plane is transferred to the photoconductive member using dot-on-dot formatting, it is not developed on top of the previously developed color plane and therefore does not generate counter potentials which would otherwise need to be compensated for by using complex algorithms. On the contrary, as a result of the low voltage levels generated on the intermediate transfer member, no significant counter potentials are developed as each color plane is superimposed on the previous color plane on the surface of the intermediate transfer member. Then, the developed composite image on the intermediate transfer member can be directly transferred by conventional image transfer methods onto the surface of an adjacent print medium.

It will be appreciated by those skilled in the art that there are numerous attendant advantages associated with the above described novel method and apparatus. Among these novel features include the fact that no high voltage corona system is required for the formation of the composite color image. In addition, the cleaning system used for the image development system described herein requires no in and out camming action. Moreover, and equally important, is the fact that since no complex algorithm is required to compensate for the above counter potential problem, the net charge on the developed toner will now be higher than in the compensated case and will thus have a stronger tendency to hold the developed image in place in each color plane, thereby enhancing overall image quality.

Accordingly, it is another object of this invention to provide a new and improved dry powder color electrophotographic method and system of the type described which produces an improved image quality and resolution by the use of DOD color formatting.

Another object of this invention is to provide a new and improved method and system of the type described which eliminates the requirement for high voltage corona systems and undesirable ozone generated thereby characteristic of the prior art.

Another object of this invention is to provide a new and improved method and system of the type described wherein the cleaning system is fixed and requires no in and out camming action.

Another object of this invention is to provide a new and improved method and system of the type described which is relatively straightforward in construction and reliable in operation.

Another object of this invention is provide a new and improved method and system of the type described which overcomes the problems associated with fluid management and toner charge compensation problems characteristic of liquid toner color development systems for electrophotographic color printers.

The above brief summary of the invention, together with its attendant objects, many advantages and novel features, will become better understood with reference to the following description of the accompanying drawings.

DETAILED DESCRIPTION OF THE PREFERRED EMBODIMENT

FIG. 1 is an abbreviated schematic cross sectional diagram and electrical biasing arrangement showing the color image development and transfer apparatus constructed in accordance with a preferred embodiment of the invention. This apparatus utilizes an intermediate transfer belt in novel combination with a photoconductive belt which are also operative with a plurality of electrostatic color projection units. These color projection units are described in detail in the remaining figures.

DETAILED DESCRIPTION OF THE DRAWINGS

Figure 1:
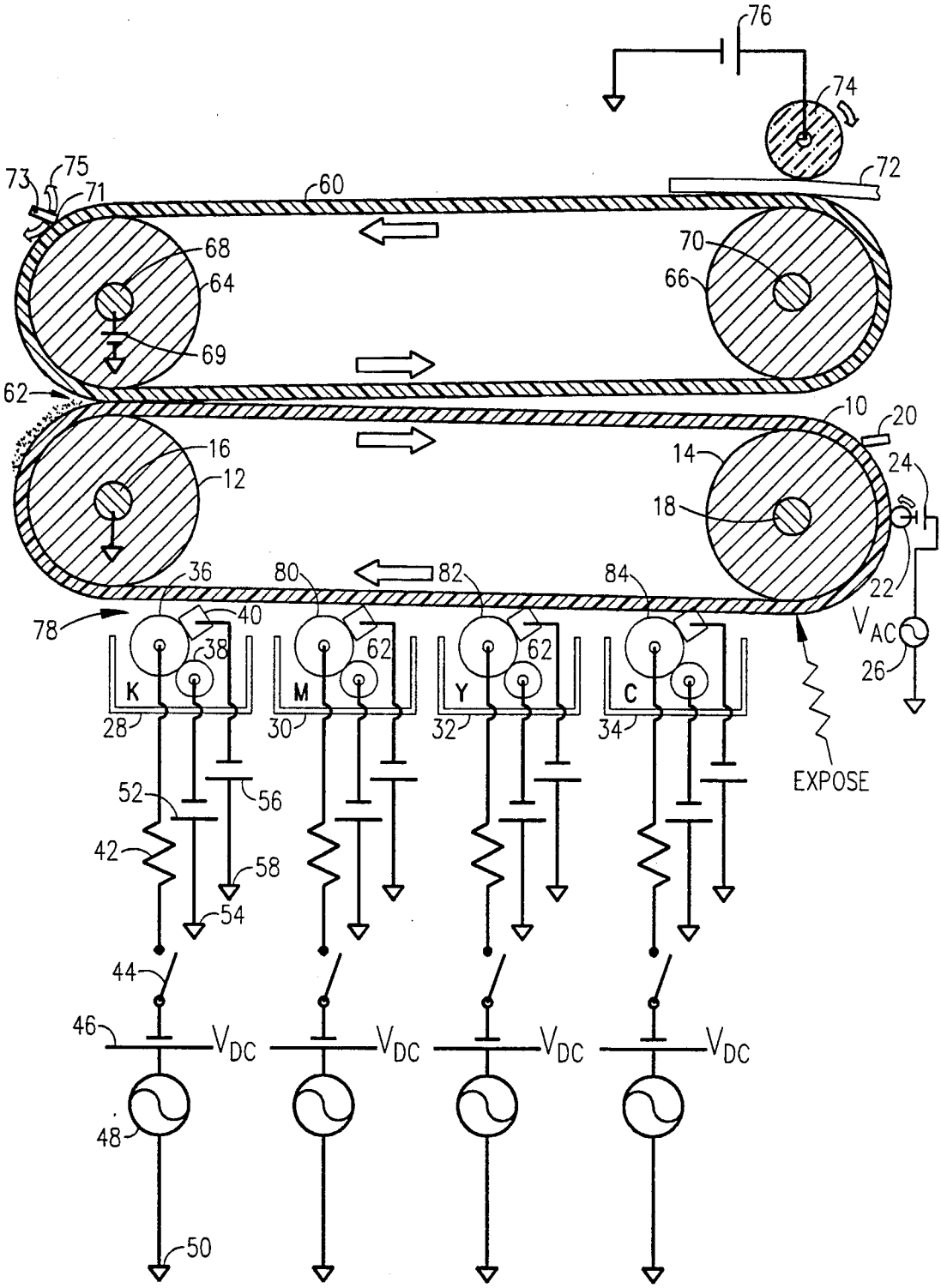

Referring now to FIG. 1, there is shown a photoconductive belt 10 which driven around two spaced apart rollers 12 and 14, each having a core and ground plane member 16 and 18, respectively, mounted at the central axis of rotation of the two rollers 12 and 14. The photoconductive belt 10 is provided with a cleaning wiper blade 20 and a bias and charging roller 22 which is connected as shown first through a source of DC bias 24 and then through a source of AC bias 26 to ground potential. This AC and DC biasing arrangement shown at 22, 24, and 26 in FIG. 1 provides a relatively low level of biasing of the photoconductive belt 10, thereby producing no significant counter potentials which must be compensated for as in the case of the above described dry power systems using DOD formatting.

A plurality of color toner projection units 28, 30, 32, and 34 are linearly positioned as shown along the length or horizontal dimension of the photoconductive belt 10, and each of these color toner projection units 28, 30, 32, and 34 operate in the manner described in my copending application Ser. No. 07/847,445 identified above. Each of these color toner projection units, e.g. 28, will include a developer roller or sleeve 36 positioned adjacent to a charge applicator and biasing roller 38 and further adjacent to a metering bar or blade 40, all of which components are described in greater detail below in the remaining figures of the specification. The developer roller or sleeve 36 is connected through a series resistance 42 and a switch 44 to first a source of DC bias 46 and then through a source of AC bias 48 to ground potential at node 50. Since all of these color toner projection units 28, 30, 32, and 34 are identical except for the color of toner projected electrostatically therefrom, only the black or K color toner projection unit 28 is described herein with reference to FIG. 1.

The toner applicator and charging roller 38 is connected through a source of DC bias 52 and to ground potential at node 54, whereas the metering blade or bar 40 is also connected through a source 56 of DC bias to ground potential at node 58.

An intermediate transfer member (ITM) in the form of an intermediate transfer belt 60 is positioned as shown in direct physical contact with the photoconductive belt 10 and at the juncture 62 where the two belts 10 and 60 come together in direct physical contact between the left hand roller 12 driving the photoconductive belt 10 and the left hand roller 64 driving the intermediate transfer belt (ITB) 60. The two drive rollers 64 and 66 for the intermediate transfer belt 60 also include core and ground plane members 68 and 70, respectively, located at the central axis of rotation of the left and right hand rollers 64 and 66. The core and ground plane member 68 is connected to the positive terminal of a grounded DC bias voltage source 69. In addition, aa rotatable wiper blade 71 is provided as shown adjacent to the left hand end of the intermediate transfer belt 60 and may be rotated about pivot point 73 and away from the intermediate transfer belt 60 during the transfer of the four color planes from the photoconductive belt 10. Then, after the composite color image has been transferred to the media 72 the wiper blade 71 is rotated downwardly into contacts with the ITB member 60 to scrape off the residual toner from the surface of the ITB member 60.

The composite developed color image on the surface of the intermediate transfer belt 60 is transferred to a print medium 72 in a manner more particularly described below, and the print medium 72 passes between the outer surface of the intermediate transfer belt 60 and a conventional transfer roller 74 which is also connected to a source of DC bias 76. This source of DC bias 76 provides electrostatic assistance in transferring the image from the surface of the intermediate transfer belt 60 to the downwardly facing surface of the print media 72. Also, the transfer roller 74 may be constructed in accordance with the teachings of my above identified copending applications, albeit modified to accommodate the dry toner powders utilized herein.

In operation, the partial color image in each of the black, magenta, yellow, and cyan color planes are successively and sequentially electrostatically projected across the gaps or spacings 78 between the outer surfaces of the developer rollers or sleeves 36 and onto the outer surface of the photoconductive belt 10 once each 360° rotation of the photoconductive belt 10 around the two drive rollers 12 and 14. Then, each color plane is transferred by physical and thermal interaction at the juncture 62 between the two left hand rollers 12 and 64 of the photoconductive belt 10 and intermediate transfer belt 60, respectively.

In this manner, each successive color plane is stored on the outer surface of the intermediate transfer member 60 before the next color plane is electrostatically projected across the next gap 80, 82, and 84 in succession, until all of the black, yellow, magenta, and cyan color planes have been transferred from the surface of the photoconductive belt 12 and superimposed, one upon another, on the intermediate transfer belt 60. When this process has been completed, the transfer roller 74 forces the print media 72 down into direct physical contact with the surface of the intermediate transfer belt 60 and in the position shown in FIG. 1 to thereby transfer the composite color image onto the surface of the print medium 72.

Since each color plane is sequentially transferred from the photoconductive belt 10 onto the intermediate transfer belt 60 before the next color plane is developed on the surface of the photoconductive belt 10 and further as a result of using a relatively low voltage biasing scheme for the AC and DC biasing network 22, 24, and 26, there are no significant counter potentials developed in the gaps 78, 80, 82, and 84 between the four black, magenta, yellow, and cyan developer rollers 36 and the surface of the photoconductive belt 10. This feature in turn means that no complex algorithms are required to compensate for otherwise present counter potentials developed in these gaps when high voltage corona systems are used with a photoconductive drum or belt 10.

This feature not only means that dot-on-dot formatting may be utilized in order to obtain the highest possible resolutions for the developed and printed image, but in addition, the net charge on the toner remains relatively high as a result of not using these complex algorithms. This operation in turn has the tendency to hold the developed image more tightly in place on both the photoconductor belt 10 and the intermediate transfer member 60 and thereby even further enhances image and print quality.

Figure 2:
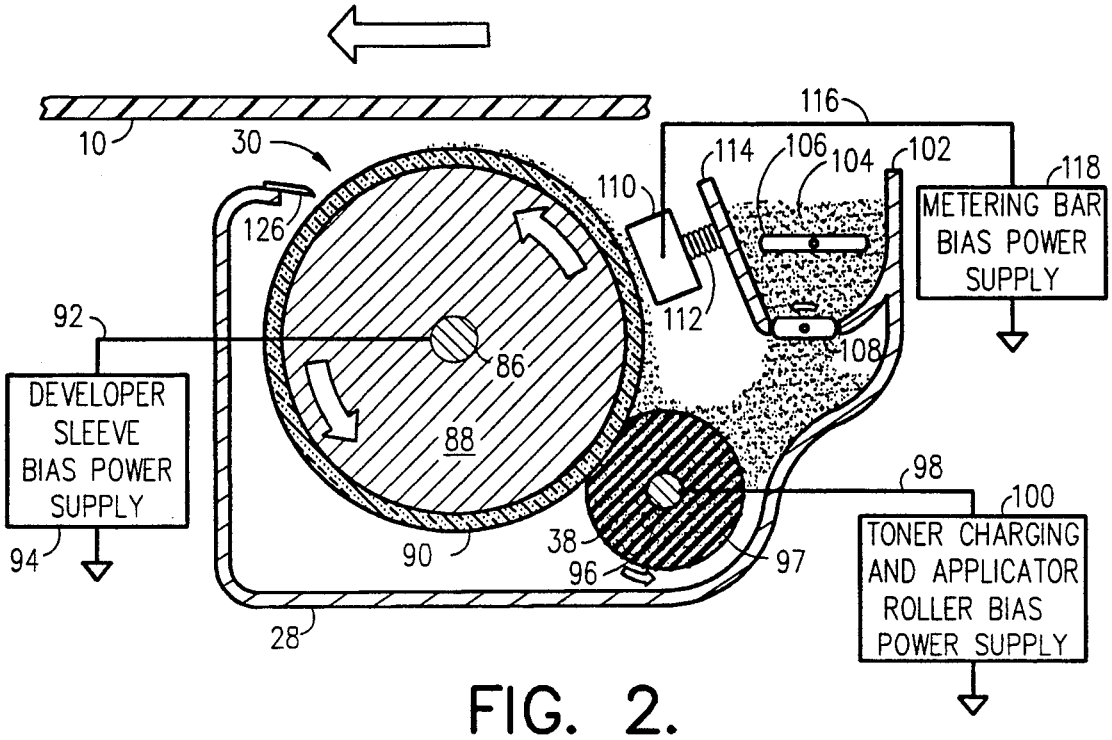
FIG. 2 is an abbreviated schematic cross section view showing one method for metering the non-magnetic dry toner particles onto the surface of a developer sleeve within one of the color toner projection units of the developer system shown in FIG. 1.

Referring now in sequence to FIG. 2 through 6, there is described a more detailed operation of the individual color toner projection units 28, 30, 32, and 34. In FIG. 2, the color developer unit 28 includes an outer housing constructed generally in the geometry shown in this figure, and each development unit 28 includes therein a developer cylinder 36 comprising an inner conductive core and ground plane member 86, an intermediate metal sleeve 88, and an outer overcoating film 90. This film 90 can be a toner charging-compatible polymeric material with a volume resistivity of the order of $10^4$ ohm·cm to $10^{12}$ ohm·cm. The inner core member 86 is connected by way of line 92 to a source 94 of both AC and DC supply voltage.

The inner metal sleeve member 88 is constructed, for example, of aluminum or steel, and is operative to rotate about its central axis in a counter-clockwise direction as shown and against the surface of a soft core toner applicator and charging roller 38 which may be constructed, for example, of a conductive polyurethane foam. The charging roller 38 also includes an inner conductive core member 96 around which the soft core material 97 is disposed, and the inner core and ground plane member 96 is connected by way of line 98 to a source of DC charging voltage 100. During operation, the toner applicator and charging roller 38 rotates against the developer roller 36 in a counter clockwise direction and serves to help charge the dry color toner particles due to the interaction between toner and the overcoated developer cylinder 36. This action also provides a means to transport charged toner layers from the metering apparatus described below.

A toner delivery and metering apparatus includes a generally U-shaped or trough member 102 which is operative to receive toner material 104 therein comprising dry non-magnetic toner particles which are agitated and stirred with an oscillating or rotating stirrer blade 106 and then passed between the side walls of a toner supply rod 108. The toner supply rod 108 is rotatably mounted in the bottom of the trough member 102 and is operative to pass the toner particles onto the surface of the applicator and charging roller 38 by controlled oscillatory and agitating motion at the lower opening within the trough member 102.

The metering apparatus 102 shown in FIG. 2 further includes a metering bar 110 which is connected through a spring biasing member 112 to the left hand wall 114 of the trough member 102 and is lightly spring biased against the surface of the overcoating layer 90 of the developer roller 30. This metering arrangement controls the toner layer thickness being transferred onto the surface of the developer cylinder 30 during operation of the unit 28. The toner metering bar 110 is also connected by way of a supply voltage line 116 to a source 118 of DC supply voltage which operates to control the amount of charge that is applied to the toner particles on the surface of the developer sleeve 36.

The charging of the toner is accomplished primarily by the rubbing action between the surfaces of the toner and the developer sleeve 36 which tribo electrically charges the toner due to the interaction between the two surfaces. Some additional toner charging is also provided by the toner being in direct contact with the soft, electrically biased, conductive open cell urethane foam roller 97. This toner charging process ultimately creates a thick toner layer on the developer sleeve 36 which is metered by the metering bar 110 prior to being projected or developed onto the surface of the photoconductive belt 10.

Regarding the toner metering process shown in FIG. 2, this metering bar apparatus uses both mechanical and electrical forces to control the amount of toner dispersed onto the surface of the developer sleeve 36. The metering bar 110 is spring biased and is also electrically biased to the same polarity as the toner and at a potential which is somewhat greater than the potential level on the developer sleeve 36. The electrostatic and mechanical compression generated by this metering apparatus provides a thin, well controlled toner layer thickness on the developer sleeve 36 surface. This additional contact between the toner and the biased metering bar 110 also enhances the toner charge levels prior to development and helps reduce or eliminate "wrong sign" toner particles.

Thus, in operation, the inner conductive core 86 of the developer cylinder 36 is connected to both an AC and DC bias voltages during the counter-clockwise rotation thereof, whereas the charging roller 38 is supplied with a DC voltage from the DC source 100, also during the counterclockwise rotation of the charging roller 38. In addition, the metering bar 110 is also supplied with a DC supply voltage for biasing operation of the unit 28 which is described in more detail below with reference to FIGS. 3 through 6.

Figure 3:
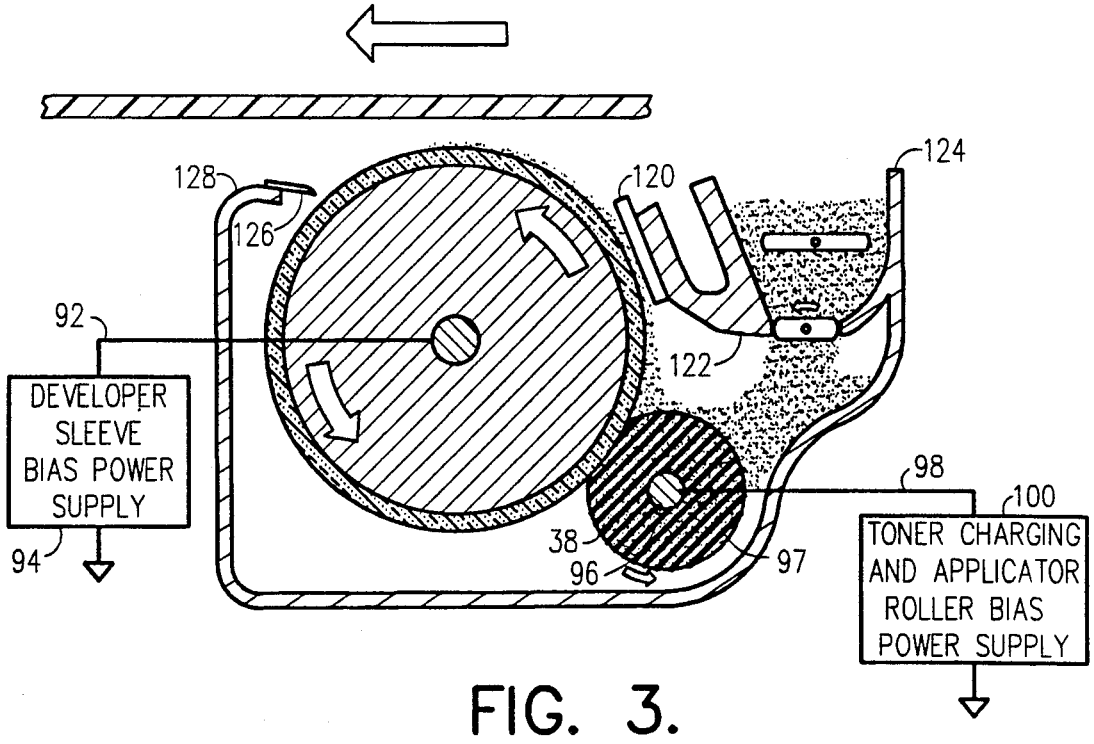
FIG. 3 is a schematic cross section view showing another method for metering the non-magnetic dry toner particles onto the developer sleeve of one of the color toner projection units in FIG. 1.

Referring now to FIG. 3, this figure shows an alternative embodiment of the developing unit 28 shown in FIG. 1 wherein the metering bar of FIG. 2 has now been replaced by a metering blade 120 which advantageously may be directly secured as shown to one side wall 122 of the trough member 124. All other constructional details of FIG. 3 are identical to those previously described above in FIG. 2, including the use of a non-contact cylinder seal 126 mounted on top of the left hand side wall 128 of the developer unit 28 to prevent toner leakage from the housing 28.

Regarding the metering blade approach as shown in FIG. 3 herein, this apparatus includes an elastomeric blade 120 that is unbiased. This method removes the more loosely bound toner particles which are not subjected to the high coulombic forces between the toner at the surface of the developer cylinder sleeve 36.

Figure 4:
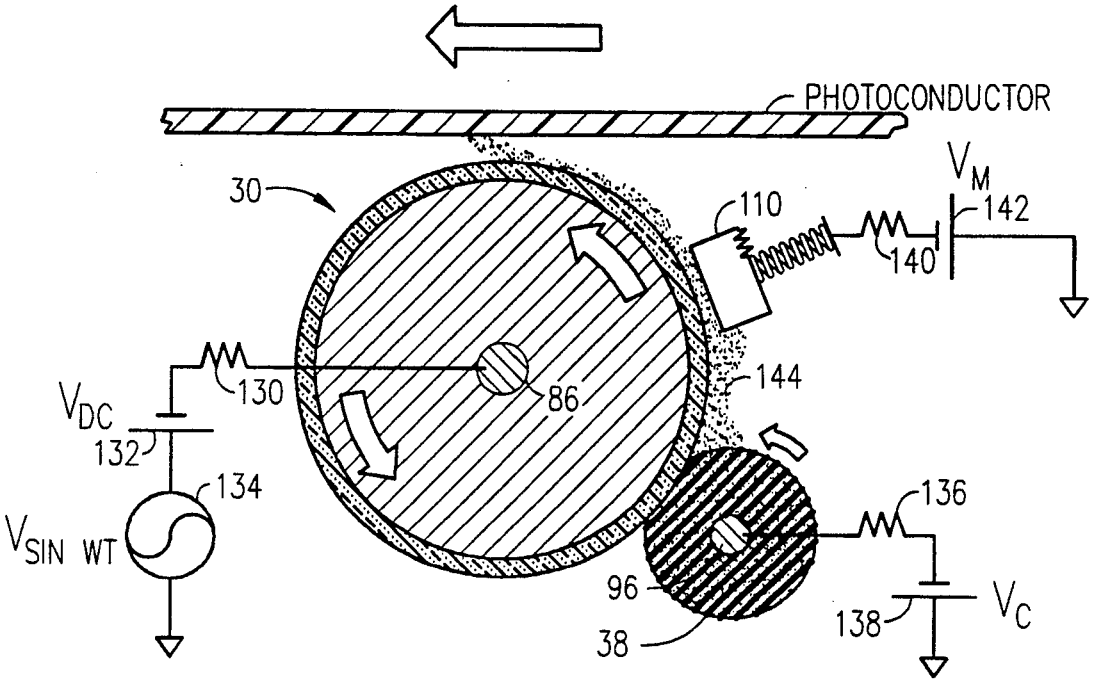
FIG. 4 shows the basic electrical biasing arrangement used for all of the four color toner projection units of the development system shown in FIG. 1.

Referring now to FIG. 4, the schematic diagram in this figure describes more particularly the AC and DC biasing arrangement for the developer units 28 shown in FIGS. 2 and 3 above. The developer cylinder 36 has its inner core member 86 connected through a current limiting resistor 130 to first a source of DC bias 132 and then to a source of AC bias voltage 134 designated as $V_a$Sin(wt), where $V_a$ is the peak AC voltage and wt is the radian frequency-time factor associated with the sine wave (Sin) AC voltage received from the AC source 134. The toner charging roller 38 has its inner core member 96 also connected through a current limiting resistor 136 to a source 138 of DC bias voltage. Similarly, the metering bar 110 is also connected through a current limiting resistor 140 to a source 142 of DC voltage.

Figure 5A:
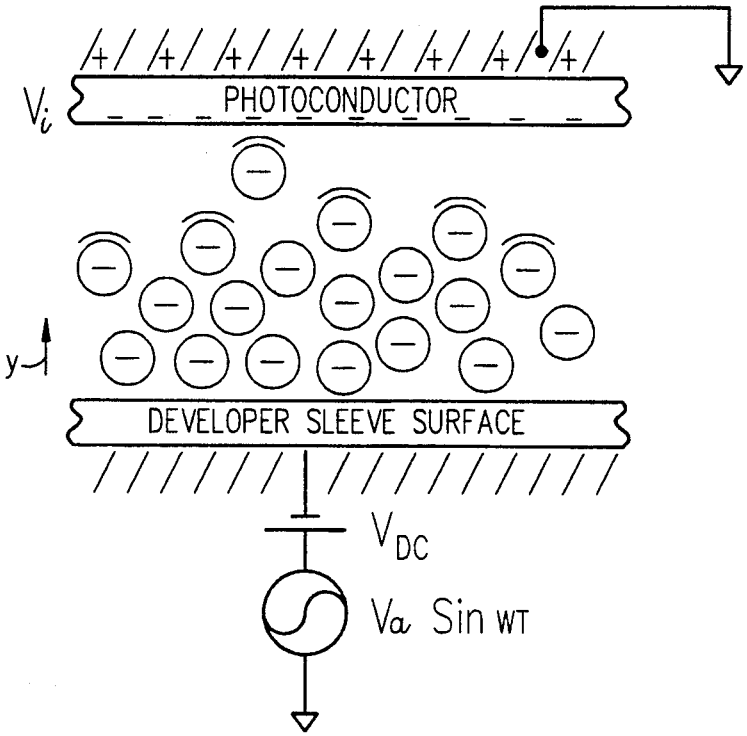
FIG. 5A is a development model showing the motion of charged toner between the developer sleeve surface and the photoconductive surface for the biased arrangement shown in FIG. 3. This is a discharge area development (DAD) example using a negatively charged photoconductor and toner.
Figure 5B:
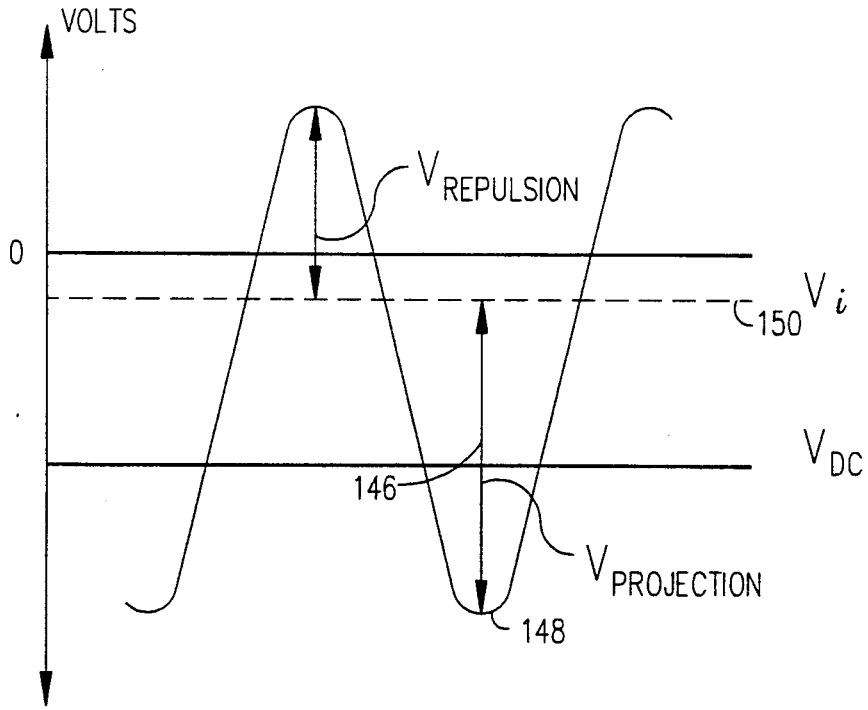
FIG. 5B is a waveform diagram showing the magnitude of the toner charge projection voltage, $V_{PROJECTION}$, at the developer roller and the charge repulsion voltage, $V_{REPULSION}$, at the photoconductive member as a function of the AC bias voltage $V_a\mathrm{Sin}(wt)$.

Referring again to FIG. 4 in combination with the schematic diagram in FIG. 5A and the waveform diagram in FIG. 5B, the projection voltage, $V_{PROJECTION}$, applied to the toner charged particles 144 located between the surface of the photoconductor member 10 and the surface 90 of the developer sleeve 36 is shown with the magnitude indicated by the arrow 146 in FIG. 5B extending between the sine wave peak voltage 148 and the voltage level, $V_i$, indicated at DC level 150 in FIG. 5B. This projection voltage is defined by equation 1 below as follows:

$$|V_{PROJECTION}| = V_{DC} + V_{TONER} - V_i \pm V_a \, Sin(wt) \quad \text{Equation No. 1}$$

where $V_{DC}+V_a$Sin(wt) is the AC and DC bias applied to the developer cylinder 36, $V_i$ is the voltage across the surface of the exposed photoconductive belt 10, and $V_{TONER}$ is the voltage resulting from the effect of the layers of charged toner. This projection potential serves to overcome the toner adhesion to the developer cylinder 36, thereby propelling the properly charged particles onto the surface of the photoconductor 10 in regions that have been exposed by the imaging system.

The repulsion voltage acting on the toner particles in the gap between the developer roller 36 and the photoconductive belt 10, $V_{REPULSION}$, is defined by Equation No. 2 below. This repulsion voltage is typically quite small in regions where the photoconductor has been exposed as expressed in Equation No. 2 below, and quite large in areas that have not been exposed. This potential serves to repel properly charged toners from background regions, and should be thought of as increasing in effect as the potential on the photoconductor increases from the relatively low $V_i$ potential up to the level of the background regions. This latter level is typically greater in magnitude than the sum of $V_{DC}+V_{TONER}$.

$$|V_{REPULSION}| = V_i - V_{DC} - V_{TONER} \pm V_a \, Sin(wt) \quad \text{Equation No. 2}$$

During this toner development and toner projection process across this gap, the dry powder toner development process utilizes a time varying electrostatic field which projects the charged toners across this air gap between the photoconductor belt 10 and the toner laden developer sleeve 36. The colored, non-magnetic, monocomponent toners are projected toward the surface of the photoconductor surface 10 with a force and velocity that is dependent upon the magnitude of the projection potential as well as certain other physical and electrical parameters that affect the adhesion of the toner to the developer sleeve 36. The absolute magnitudes of these projection and repulsion potentials are given in Equations 1 and 2 above.

In Equation No. 3 below, there is set forth the relationship of motion for toners moving in the air space between the biased developer cylinder sleeve 36 and the photoconductor belt 10. This expression is a second order differential equation as follows:

$$\frac{md^2y}{dt^2} + 6n\frac{Rdy}{dt} = q[E_{DC} + E_{AC}]$$

where:

m = toner mass (grams)
q = toner charge (coulombs)
n = viscosity of the air gap space in poise (grams/cm sec)
R = toner radius (cm)
$E_{DC}$ = DC electrostatic field (volts/cm)
$E_{AC}$ = AC electrostatic field (volts/cm)
$V_{DC}$ = DC bias on developer cylinder sleeve (volts)
$V_{AC} = V_a$Sin(wt)
$E_y = E_{DC} + E_{AC}$ $V_a$=peak AC bias volts on developer sleeve (volts)
$V_i$=image potential on photoconductor belt after exposure (volts)
w=radian frequency=2 $\pi$ f (radian/sec)
f=AC frequency (Hertz)
t=time (sec)
y=distance (cm)

The solution to the differential Equation No. 3 above provides an expression for the approximate distance (y) that the toner particles travel as a function of these parameters for a given amount of time (t). Optimization and characterization of the toner projection mechanism can be achieved and verified using the solution to this fundamental equation of motion.

Figure 6:
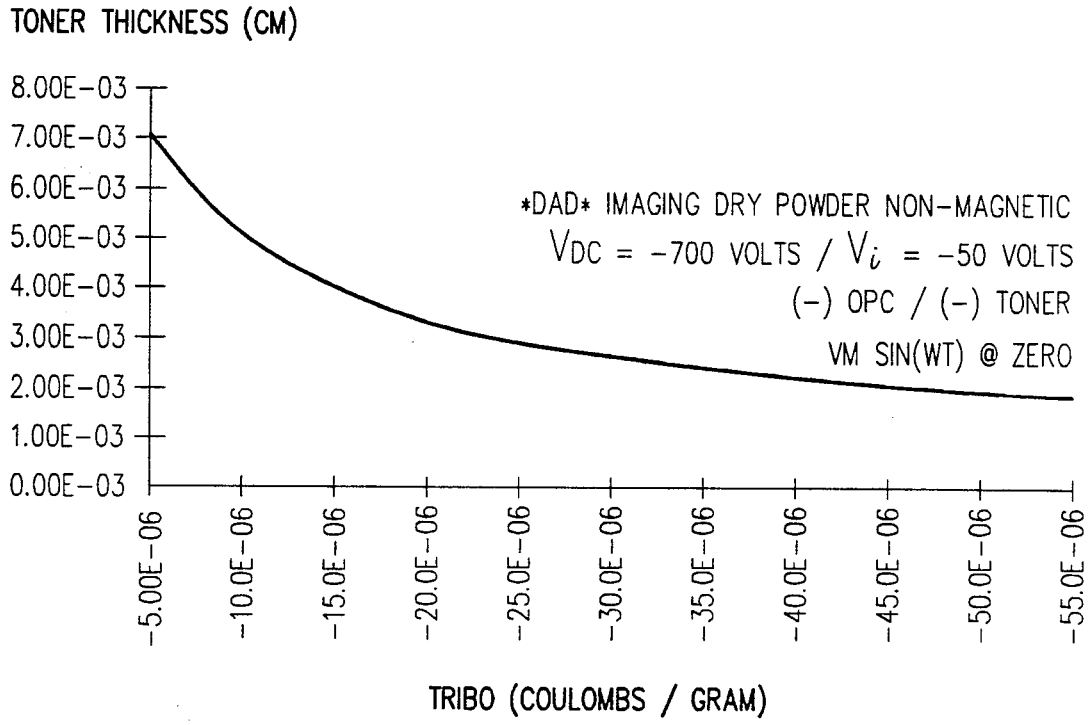
FIG. 6 is a graph of the developed toner thickness on the surface of the exposed regions of the photoconductive drum as a function of charge per unit of mass of the toner (tribo) assuming development to completion which has fully neutralized the development field.

Referring now to FIG. 6, this figure shows a graph of the toner layer thickness in centimeters developed onto the surface of the photoconductor in the imaged areas as a function of tribo which is a measurement in coulombs per gram of charge on the toner. The effects of the toner charge per unit mass (tribo) on the amount of toner developed on the photoconductor is also shown in FIG. 6. This plot shows the expected toner layer thickness resulting from toner charged from about $-5.0\times10^{-6}$ coulombs per gram to $-50\times10^{-6}$ coulombs per gram. This example assumes the development to completion with an DC voltage, $V_{DC}$, at about $-700$ volts and $V_i$ at $-50$ volts. The toner layer thicknesses will vary over a range of about $8.0\times10^{-3}$ centimeters when the tribo is $-5.0\times10^{-6}$ coulombs down to nearly $2\times10^{-3}$ centimeters when the tribo is $-50\times10^{-6}$ coulombs. A typical value for the toner charge would be $-15\times10^{-6}$ coulombs per gram, which can produce a developed toner image layer thickness of about $4\times10^{-3}$ centimeters on the photoconductor 10.

Various modifications may be made in and to the above described embodiments without departing from the spirit and scope of the invention. For example, various edge sharpening techniques and resolution enhancement technology (RET) and edge color enhancements may be employed in the above described embodiments in order to increase edge smoothness and tint quality and reduce color fringe effects. In addition, the present invention is not limited to the use of a roller driven photoconductive belt and a roller driven intermediate transfer member as shown in the FIG. 1 apparatus, and may instead use cylindrical drums in order to accomplish the above described intermediate transfer function in accordance with the principles and teachings of the present invention.

Accordingly, it is to be understood that various constructional and circuit design modifications within the skill of the art are clearly with the scope of the following appended claims.

I claim:

1. Apparatus for developing and printing color images including, in combination:

a. a photoconductive member, b. a plurality of color toner projection units spaced a certain distance from said photoconductive member and operative for projecting dry color toners onto the surface of said photoconductive member, c. an intermediate transfer member positioned in direct contact with said photoconductive member and being operatively driven to sequentially receive color toners in each of a plurality of color planes, and d. image transfer means for driving a print medium against said intermediate transfer member and for transferring a composite color image onto the surface of said print medium.

2. The apparatus defined in claim 1 wherein said photoconductive member is a belt driven by two spaced apart rollers.

3. The apparatus defined in claim 1 wherein said intermediate transfer member is a belt operatively driven by two spaced apart rollers.

4. The apparatus defined in claim 1 wherein each of said photoconductive member and intermediate transfer member includes a belt driven around two spaced apart rollers wherein rollers within each of said belts are driven directly against each other, with each belt passing between each roller in direct physical contact for transferring each color plane from said photoconductive belt to said intermediate transfer belt, and the other roller within said intermediate transfer belt being directly driven against the print medium passing between said intermediate transfer belt and a transfer roller.

5. A method for developing and printing color images on a print medium comprising the steps of:

a. sequentially projecting dry powder color toners onto a photoconductive member in each of the plurality of color planes, b. sequentially transferring by direct contact each color plane from said photoconductive member to an intermediate transfer member before the next color plane is transferred by said photoconductive member and until all color planes have been super imposed one upon another on said intermediate transfer member to form a composite color image thereon, and thereafter c. transferring said composite color image from said intermediate transfer member to said print medium, d. wherein said dry powder color toners are electrostatically projected from a plurality of color toner projection units onto the surface of said photoconductive member, e. controlling said electrostatic projection from said color toner projection units by a combination of AC and DC biasing, and f. wherein said color planes are transferred by driving a photoconductive belt directly against an intermediate transfer belt and by driving said intermediate transfer belt against a transfer roller adjacent to which the print medium passes.

6. A method for developing and printing color images which includes electrostatically projecting a plurality of color planes onto a photoconductive member in dot-on-dot (DOD) formatting and using dry color toners, storing said color planes on an intermediate transfer member to form a composite color image, and then transferring said composite color image onto an adjacent print media, wherein said dry powder color toners are electrostatically projected from a plurality of color toner projection units onto the surface of said photoconductive member, controlling said electrostatic projection from said color toner projection units by a combination of AC and DC biasing, wherein said color planes are transferred by driving a photoconductive belt directly against an intermediate transfer belt and by driving said intermediate transfer belt against a transfer roller adjacent to which the print medium passes.

* * * * *